US005812165A

United States Patent [19]

Boyd et al.

[11] Patent Number: 5,812,165

[45] Date of Patent: Sep. 22, 1998

[54] LEAK RESISTANT INK-JET PEN

[75] Inventors: Melissa D. Boyd; Kenneth L. Christensen; Julie Jo Bostater; Naoto Kawamura, all of Corvallis, Oreg.

[73] Assignee: Hewlett-Packard Company, Palo Alto, Calif.

[21] Appl. No.: 613,444

[22] Filed: Mar. 4, 1996

Related U.S. Application Data

[63] Continuation-in-part of Ser. No. 389,608, Feb. 15, 1995, which is a continuation of Ser. No. 75,357, Jun. 9, 1993, abandoned, which is a continuation of Ser. No. 752,158, Aug. 29, 1991, abandoned.

[51] Int. Cl.[6] ..... B41J 2/175

[52] U.S. Cl. ..... 347/87; 347/92

[58] Field of Search ..... 347/92, 87, 86

[56] References Cited

U.S. PATENT DOCUMENTS

| | | | |
|---|---|---|---|
| 2,587,949 | 3/1952 | Zodtner | 120/50 |
| 4,095,237 | 6/1978 | Amberntsson et al. | 346/140 R |
| 4,215,354 | 7/1980 | Larsson | 346/140 R |
| 4,312,010 | 1/1982 | Doring | 346/140 R |
| 4,368,478 | 1/1983 | Koto | 346/140 R |
| 4,382,707 | 5/1983 | Anderka | 401/198 |
| 4,549,191 | 10/1985 | Fukachi et al. | 346/140 R |
| 4,638,337 | 1/1987 | Torpey et al. | 346/140 R |
| 4,671,692 | 6/1987 | Inaba | 401/190 |
| 4,689,641 | 8/1987 | Scardovi et al. | 346/140 R |
| 4,788,556 | 11/1988 | Hoisington et al. | 346/140 R |
| 4,791,438 | 12/1988 | Hanson et al. | 346/140 R |
| 4,929,969 | 5/1990 | Morris | 346/140 R |
| 4,931,811 | 6/1990 | Cowger et al. | 346/140 R |
| 4,961,082 | 10/1990 | Hoisington et al. | 346/140 R |
| 4,998,120 | 3/1991 | Kato et al. | 346/140 R |
| 5,025,271 | 6/1991 | Baker et al. | 346/140 R |
| 5,105,209 | 4/1992 | Koto et al. | 346/140 R |
| 5,157,420 | 10/1992 | Naka et al. | 346/140 R |
| 5,296,876 | 3/1994 | Yamaguchi et al. | 346/140 R |
| 5,341,162 | 8/1994 | Hermanson et al. | 347/92 |

FOREIGN PATENT DOCUMENTS

| | | | |
|---|---|---|---|
| 076708 | 4/1983 | European Pat. Off. | B41J 3/04 |
| 0603504 | 6/1994 | European Pat. Off. | B41J 2/175 |
| 3705446 | 12/1987 | Germany | B41J 3/04 |
| 59-120462 | 7/1984 | Japan | B41J 3/04 |
| 61-173945 | 8/1986 | Japan | B41J 3/04 |
| 61-193859 | 8/1986 | Japan | B41J 3/04 |
| 145156 | 6/1989 | Japan | 347/92 |
| 308645 | 12/1989 | Japan | B41J 3/04 |
| 250046 | 9/1992 | Japan | 347/92 |
| 77440 | 3/1993 | Japan | 347/92 |

*Primary Examiner*—Valerie Lund
*Attorney, Agent, or Firm*—Raymond A. Jenski

[57] ABSTRACT

A three-color ink-jet cartridge has a conduit connecting an ink reservoir to a print head orifice. The conduit includes a standpipe which has a pair of internal longitudinal grooves to permit ink to flow past a trapped bubble in the standpipe thereby preventing ink leakage through the orifices when pressure changes cause the trapped bubble to expand. The conduit also includes a tube from the standpipe to the print head. Disposed longitudinally along the tube is a rib which enables capillary flow of ink around a bubble in the tube to prevent depriming of the print head.

14 Claims, 4 Drawing Sheets

LEAK RESISTANT INK-JET PEN

This patent application is a continuation-in-part of U.S. patent application Ser. No. 08/389,608 filed on Feb. 15, 1995; which is a continuation of U.S. patent application Ser. No. 08/075,357 filed on Jun. 9, 1993, abandoned; which is a continuation of U.S. patent application Ser. No. 07/752,158 filed on Aug. 29, 1991, abandoned.

This invention relates to ink-jet pens for use in computer printers.

BACKGROUND AND SUMMARY OF INVENTION

Ink-jet printers are an effective means for printing information and graphics in conjunction with personal computer work stations, for instance. An ink-jet cartridge or pen is the heart of such a printer. The ink-jet en typically has a reservoir of liquid ink with a conduit supplying the ink to a print head, which is electrically controlled to expel droplets of ink onto an adjacent piece of paper.

A multi-color ink-jet pen includes three reservoirs, each containing an open-cell foam sponge retaining a different color ink. Each reservoir is vented to ambient pressure. A separate conduit connects each reservoir to a priming head, which has an array of orifices for expelling each ink color separately. The high capillarity of the foam sufficiently resists ink flow from the reservoir so that a slight backpressure may be established at the print heat to prevent ink leakage through the orifices.

During manufacture, while the reservoirs are being filled with ink, air remaining in the conduits is substantially removed by applying suction to the orifices. Nonetheless, it is common for an air bubble to remain in a conduit after this priming process.

Normally, an increase in ambient temperature or decrease in ambient pressure will create some expansion of a trapped air bubble within the conduit. When such expansion occurs, the high-capillarity foam wicks the expanded volume of ink from the conduits back into the reservoirs, thereby preventing leakage from the orifices. This wicking effect occurs as long as there remains a continuous path of ink between the foam and the orifice.

When a large air bubble occupies a conduit, it may interrupt the continuous path of ink required for the foam to prevent leakage. This problem is most likely to occur when a bubble entirely occupies a tubular, vertical standpipe portion of the conduit adjacent to the reservoir. A fine mesh screen between the foam and standpipe prevents the bubble from entering the reservoir, trapping the bubble in the standpipe. The trapped bubble may expand as a result of ambient changes and act as a check valve to block the ink path to the reservoir. Consequently, some of the ink between the bubble and the print head is forced out of the orifices because the foam is unable to wick that volume of ink past the blocking bubble. Furthermore, an air bubble may also act to block ink from getting to the die. When that happens, the pen will stop printing because it is starved of ink.

When one color of ink leaks out of its orifice, it forms a droplet on the print head surface. The droplet may grow to encounter the orifice of another color, which absorbs it, creating a contaminated mixture. This mixture may be further drawn back into the ink pen when pressure and temperature return to normal. Consequently, proper color printing is spoiled at least until the contaminated ink is spent. The cartridge may be entirely ruined if the contamination is allowed to remain for an extended length of time.

The present invention provides an ink-jet cartridge configured to maintain an uninterrupted ink path for transmitting the wicking effect of the foam-filled reservoir through the ink flow path to the print head, even when the ink flow path is occupied by a significantly large air bubble. A sufficient fluid path to bypass such a bubble is provided by the configuration of the present invention. The leak-preventing wicking of the foam-filled reservoir is thereby maintained and depriming of the print head is avoided.

DETAILED DESCRIPTION OF A PREFERRED EMBODIMENT

Figure 1:
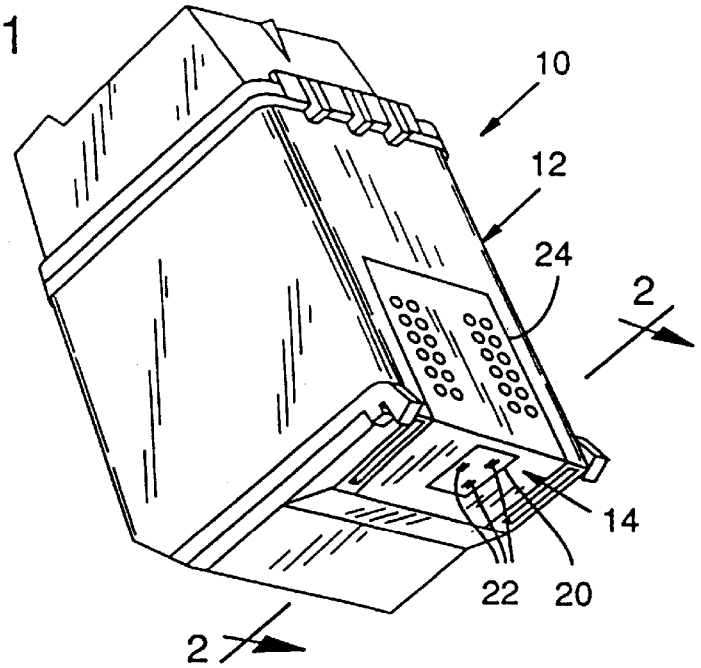
FIG. 1 is a perspective view of an ink-jet pen apparatus constructed in accordance with the invention.

FIG. 1 shows a three-color ink-jet cartridge 10 having a box-shaped body 12 with a bottom plate 14 attached to and substantially coextensive with the bottom surface of the body 12. A print head 20 is attached to the bottom plate 14. The print head defines three sets of print orifices 22 that provide apertures for expelling ink in a controlled pattern during printing. The print head 20 is electronically controlled by a printer (not shown) through a connector circuit 24 mounted on the body 12.

Figure 2:
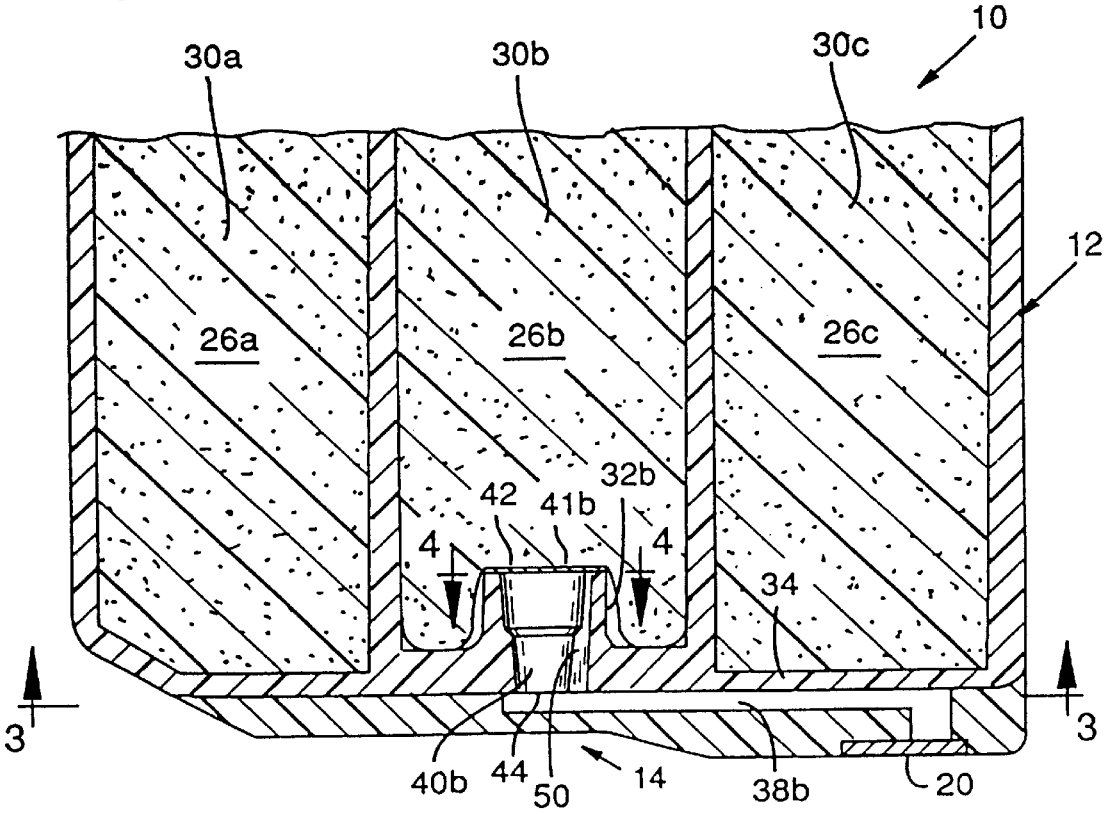
FIG. 2 is a sectional side view of the apparatus in FIG. 1 taken along line 2—2.

FIG. 2 shows the body 12 defining three similarly sized adjacent ink chambers 26*a,* 26*b,* 26*c.* Each chamber contains a different color ink: cyan, yellow and magenta, for instance. Each chamber is filled with an ink sponge 30*a,* 30*b,* 30*c* formed of open cell foam capable of absorbing and retaining substantial quantities of ink with a wicking effect that tends to draw ink in and prevent ink from leaking out of the sponge.

An open, vertical, generally cylindrical standpipe 32*a,* 32*b,* 32*c* (FIG. 3) is integrally attached to the floor of each chamber, each floor being formed by a base wall 34 of the reservoir body 12. Each standpipe 32*a,* 32*b,* 32*c* forms a conduit for fluid communication between its respective chamber 26*a,* 26*b,* 26*c* and a region outside of the reservoir base wall 34. This external region is a lateral ink channel 38*a,* 38*b,* 38*c* formed cooperatively by the bottom plate 14 and the base wall 34 of the reservoir body 12.

Figure 3:
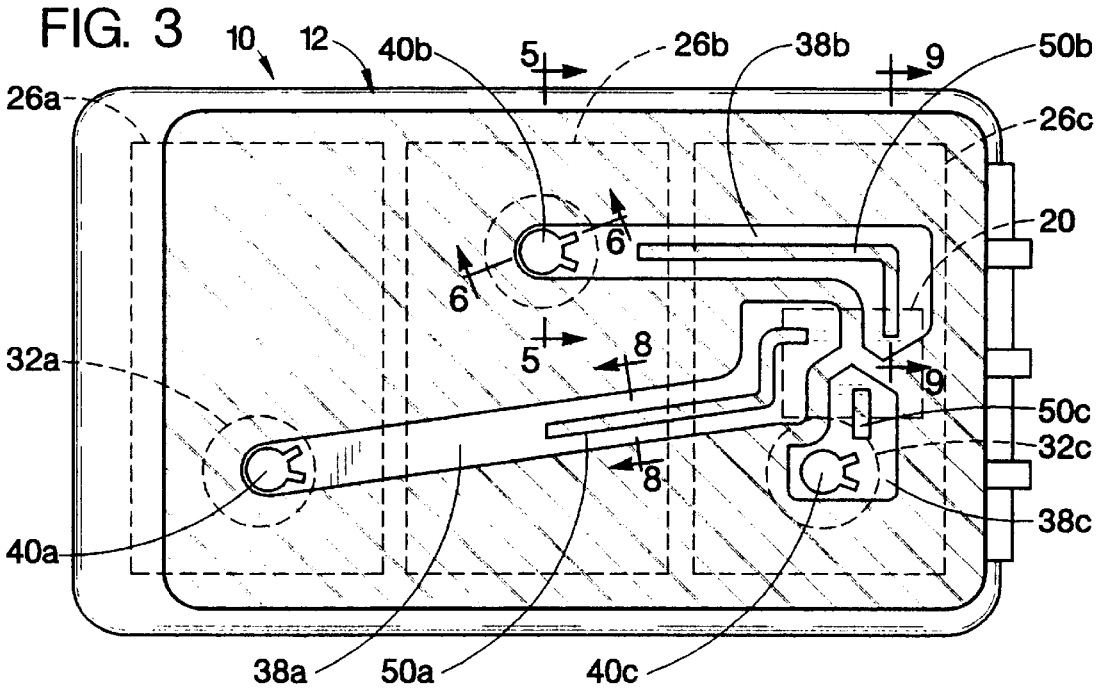
FIG. 3 is a sectional bottom view of the apparatus of FIG. 1 taken along line 3—3 in FIG. 2.

As shown in FIG. 3, the lateral channels 38*a,* 38*b,* 38*c* provide separate conduits to transmit ink from each respective standpipe 32*a,* 32*b,* 32*c* to an associated orifice set in the print head 20. Disposed within each respective one of the lateral channels are ribs 50*a,* 50*b,* 50*c.* In the preferred embodiment, each rib is formed as part of the bottom plate 14, centered in the respective ink channel, and extending part of the distance from each respective standpipe vertical passage 40*a,* 40*b,* 40*c* to the print head 20. Depending upon the geometries of various versions of ink-jet pens, the specific positions and dimensional details of the ribs may be modified without departing from the spirit of the present invention. For example, the ribs may be offset from the center of the channel or two or more ribs may be located in one or more lateral channels. These two or more ribs may be spaced to create a groove between them. It is also possible to form a groove into the bottom plate 14 without the use of ribs and realize beneficial results from such a configuration. Alternatively, the ribs may be formed as part of the reservoir base wall 34 rather than the bottom plate 14. Regardless of the particular implementation, the purpose of the rib or groove feature in each lateral channel is that of a capillary forming member to provide an alternative capillary ink flow path around an air bubble which can form in the lateral channel. Such an air bubble can block ink flow and cause the path to the print head to deprime.

Figure 9:
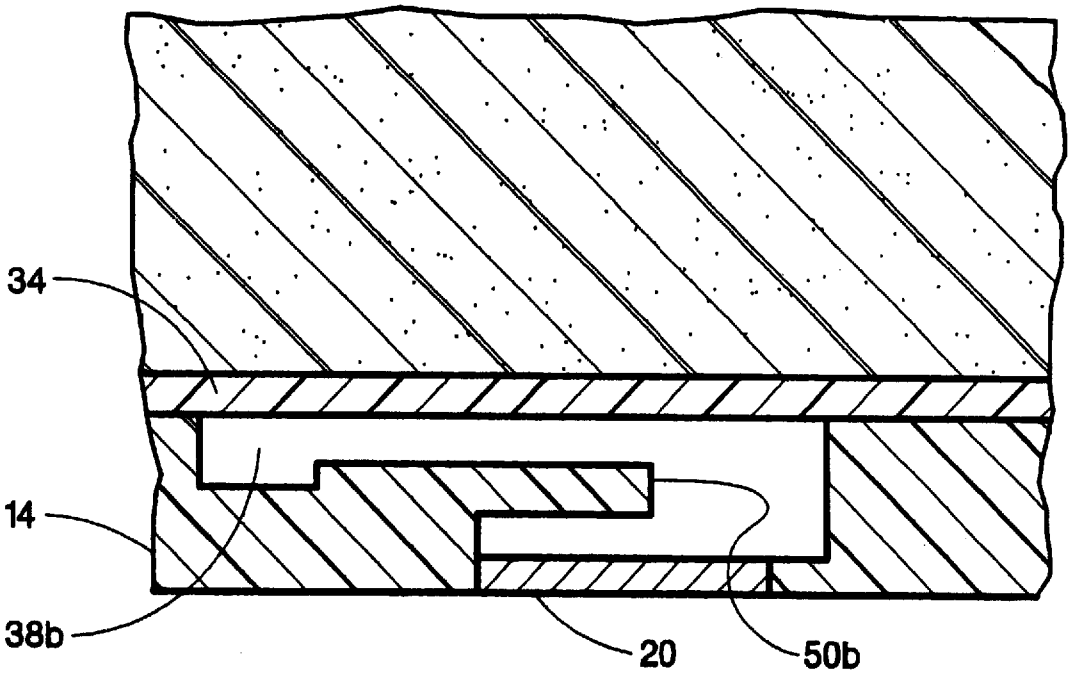
FIG. 9 is a sectional view taken along line 9—9 in FIG. 3.

To better prevent an air bubble in the lateral ink channel 38*b* from depriming the print head, the rib is extended over the opening in the bottom plate 14 leading to the print head 20. In the preferred embodiment, the rib 50*b* in FIG. 9 extends approximately 50% beyond the edge of the opening in the bottom plate 14 to the print head 20. Rib 50*a* extends the furthest over the opening of the three ribs shown.

Each standpipe defines a vertical passage 40*a,* 40*b,* 40*c*. Referring to an exemplary one standpipe 32*b* (FIG. 2), the upper end 41*b* of each standpipe is covered by a mesh screen 42. Each screen 42 contacts the respective sponge 30*b* so that the suction provided by the sponge wicking effect may draw fluid from the passage 40*b*. Each screen 42 is liquid permeable, but is fine meshed to prevent air bubbles or impurities from passing through. The standpipe passage 40*b* is terminated at its lower end by a relatively narrow aperture portion 44 in communication with the respective lateral channel 38*b*.

Figure 4:
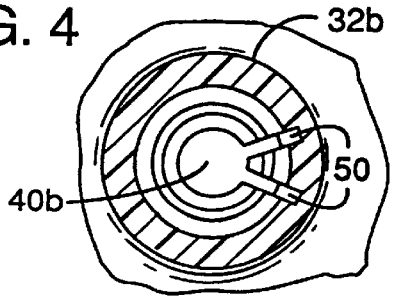
FIG. 4 is a sectional top view of a standpipe taken along line 4—4 in FIG. 2.
Figure 5:
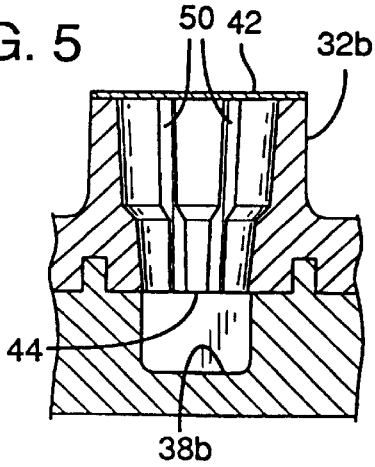
FIG. 5 is a sectional side view of a standpipe taken along line 5—5 in FIG. 3.

To realize one of the advantages of the present invention, the preferred configuration of each standpipe passage 40*a,* 40*b,* 40*c* includes a specially formed interior surface. Again referring to an exemplary standpipe 32*b,* this surface preferably includes a pair of internal grooves 50, as best shown in FIGS. 4 and 5. Each groove 50 provides a continuous path adjacent to the conduit passage 40*b* between the reservoir 26*b* and the lateral channel 38*b*. This cross-sectional configuration preferably extends the entire length of the standpipe 32*b*. Similar lateral grooves (not shown) may also be formed longitudinally in the lateral channels 38*a,* 38*b,* 38*c* in communication with the print head 20 to prevent bubble blockage therein.

Preferably, as shown in FIG. 5, all of the lateral channels 38*a,* 38*b,* 38*c* have an essentially rectangular cross-section. Alternatively, any non-circular or other shape that lacks a smoothly rounded interior cross-section may be suitable since the vertex or corner regions along the length of the channels can define bypass paths that function to allow fluid flow past a large bubble occupying the lateral channel. The bubble will not expand to entirely occupy the corners, which remain filled with ink to maintain a continuous fluid path between the reservoir 26 and the print head 20. It is a feature of the present invention that an additional capillary forming member, such as a rib structure, also occupy part of the lateral channel to provide enhanced ink flow around a potentially channel-blocking bubble.

Figure 7:
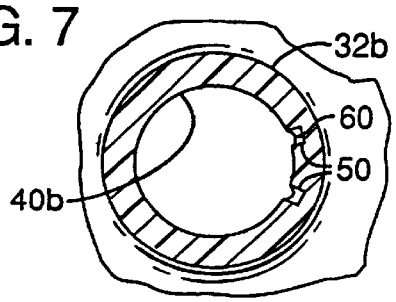
FIG. 7 is a sectional top view taken along line 7—7 in FIG. 6.
Figure 6:
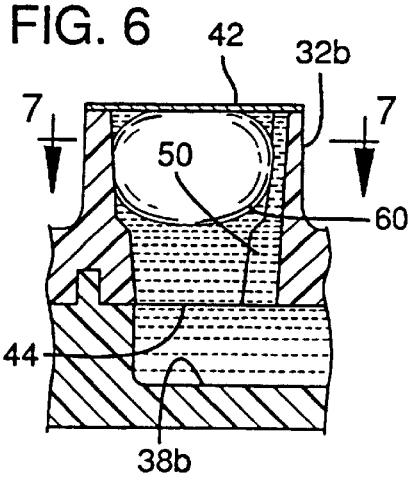
FIG. 6 is a sectional side view of a standpipe taken along line 6—6 in FIG. 3.

The primary function of the grooves 50 is to prevent air bubbles from completely blocking the passages 40*a,* 40*b,* 40*c,* thereby completely interrupting the fluid path between the reservoir and the print head. As illustrated in FIGS. 6 and 7, the ink surface tension will prevent an air bubble 60 from completely filling the internal groove 50. To penetrate and fill a gap of width W (FIG. 7), a bubble must have sufficient internal pressure to form a cylindrical bubble having a radius of $r=W/2$ or less. The bubble penetrating the groove is characterized as cylindrical because it would extend along a substantial length of the groove, as shown in FIG. 7. The internal pressure P is the amount by which the bubble pressure exceeds the pressure in the surrounding fluid. For a cylindrical bubble, $P=4(ST)/r$, where ST is the surface tension of the fluid.

In the range of geometries useful in the instant invention, a bubble will not reach a sufficiently high internal pressure P to fully occupy the groove. Before the critical pressure is reached, the bubble will expand longitudinally within the passage 40 in which it resides.

The preferred embodiment is designed for high surfactant inks with surface tension values in the range of 30 to 35 dynes/cm. The diameter of the primary passage 40 ranges between 0.095 and 0.163 inch as it tapers throughout its height. The grooves 50 preferably have a width of 0.020 inch, and depths of 0.014 to 0.016 inch. The depth-to-width ratio of the grooves is greater than one half so that a nearly semi-cylindrical bubble segment, as would be formed in a limiting case, would not occlude the groove. The groove 50 may be substantially deeper than this limiting ratio, with the added advantage of adequate fluid flow capacity through the groove.

The groove depth is limited only by the dimensions of the pen body 12 in which the grooves 50 are formed. The groove width may be reduced to ensure that even high pressure bubbles will not block the groove, but excessive narrowing will overly constrict the fluid flow through the groove, risking leakage during rapid ambient pressure changes. Extremely narrow grooves are also difficult to manufacture. With the ink formulation used, grooves wider than about 0.040 to 0.050 inch are believed to be inadequate, with this width limit varying proportionately with the surface tension properties of alternative inks employed. A wider groove would require smaller sub-grooves or sharp comers to be effective.

Thus, a continuous path of ink is maintained irrespective of bubble expansion. As a result, the wicking effect of the sponges 30 will be maintained for drawing ink through the groove 50, past a bubble in the standpipe passage and back into the chamber 26, so that the ink will not leak in the event of bubble expansion. There is always maintained a small but effective suction or backpressure throughout the conduit in the lateral channels 38*a,* 38*b,* 38*c* leading to the print head 20.

If the conduit lacked the groove feature and were entirely blocked by a bubble, the wicking effect would be blocked, and environmental changes causing expansion of the bubble would drive ink out of the print head 20. Essentially, the bubble would act as a check valve, with any expansion in the chamber forcing ink out of the orifice, as the bubble cannot penetrate the screen, and the ink cannot circumvent the bubble. In the preferred embodiment, ink downstream of the expanding bubble 60 is influenced by the combined effects of the negative pressure due to wicking by the foam sponge 30 and the neutral pressure of the orifice 22, which resists passage of fluid or air. Thus, the ink is drawn through the capillary groove 50 toward the sponge 30, rather than being forced out of the orifice.

Figure 8:
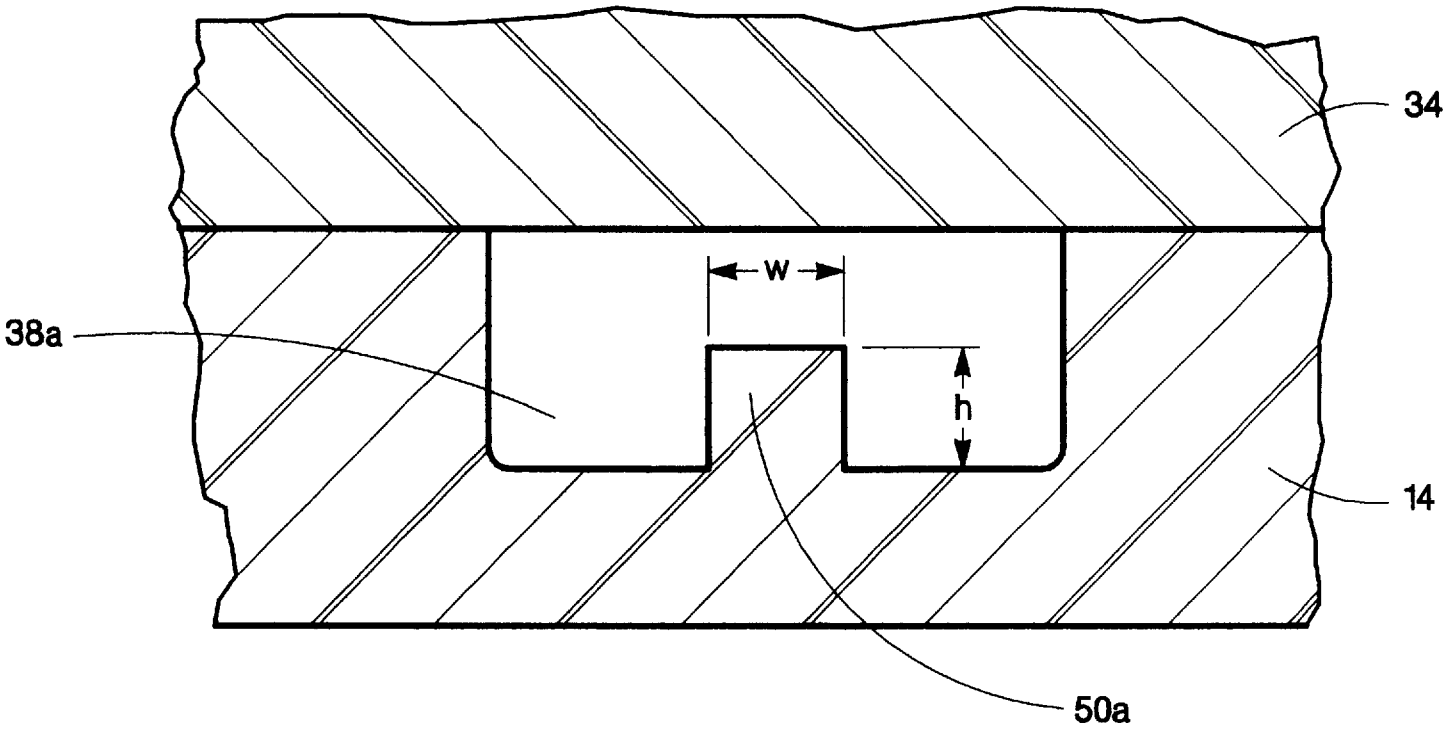
FIG. 8 is a sectional view taken along line 8—8 in FIG. 3.

Referring now to FIG. 8, the configuration of one of the lateral channels 38*a* can be seen in cross sectional detail. The bottom plate 14 is attached to the reservoir base wall 34 in a manner which creates lateral channel 38*a*. In the preferred embodiment, a rib 50*a* is molded into the bottom plate 14 to produce a partial obstruction in the lateral channel. Due to the surface tension of the ink, any air bubble which forms tends to avoid grooves and comers within the ink channel. Thus, areas surrounding the rib 50*a*—particularly those areas at the junction of the rib and the floor of the lateral ink channel—become ink capillaries around an air bubble which might form in the lateral ink channel. In the preferred embodiment, the rib is centered in the lateral ink channel, has a width of w=approximately 0.75 mm, and a height h=approximately 0.75 mm. The lateral ink channel has a typical width of 2.8 mm and a typical height of 2.9 mm.

Having illustrated and described the principles of the invention by what is presently a preferred embodiment, it should be apparent to those persons skilled in the art that the illustrated embodiment may be modified without departing from such principles. For example, the lateral channels may be provided with similar grooves to avoid air bubble blockage therein, and the standpipe interior conduit may be formed in any shape, such as a polygon with comers, to permit capillaries of ink to bypass a substantial air bubble, including a plurality of different size passages for each chamber.

In view of the many possible embodiments to which the principles of our invention may be put, it should be recognized that the detailed embodiment is illustrated only and should not be taken as limiting the scope of our invention. Rather, we claim as our invention all such embodiments that may come within the scope and spirit of the following claims and equivalents thereto.

We claim:

1. A print cartridge for an ink-jet printer comprising:

a body including a reservoir for storing ink;

a print head coupled to said body for ejecting said ink;

a conduit for providing ink flow between said reservoir and said print head;

said conduit including a first portion and a contiguous second portion, said first portion having an ink inlet in communication with said reservoir and an ink outlet having a direct fluidic connection to said second portion and said second portion formed as a channel from said first portion to a fluidic connection to said print head; and a capillary forming member disposed longitudinally in said channel and extending from said fluidic connection to said print head at least partially toward said first portion.

2. A print cartridge in accordance with claim 1 wherein said body further comprises at least a bottom surface to which a bottom plate is attached and wherein said printhead is attached to said bottom plate.

3. A print cartridge in accordance with claim 2 wherein said second portion of said conduit further comprises at least two walls, a first of said at least two walls formed by said bottom surface and a second of said at least two walls formed by said bottom plate and said longitudinally disposed capillary forming member is disposed on said bottom plate.

4. A print cartridge in accordance with claim 2 wherein said channel terminates in an opening in said bottom plate and wherein said capillary forming member extends at least part of the way over said opening in said bottom plate.

5. An ink-jet pen cartridge comprising:

a body defining a reservoir for storing ink;

a print head attached to said body for ejecting said ink;

said body including a conduit for providing ink flow between said reservoir and said print head;

said conduit including a first portion and a second portion, said first portion including an ink passage with a wall, an ink inlet in communication with said reservoir, and an ink outlet in communication with said second portion, said second portion being in communication with said print head, said conduit also including a groove formed in said wall of said ink passage and extending essentially from said ink inlet to said ink outlet, whereby ink will flow in the inlet to outlet direction and in the outlet to inlet direction around an air bubble in said ink passage;

said second portion formed as a channel having a fluidic connection to said first portion and having a fluidic connection to said print head, said channel including a capillary forming member disposed longitudinally in said channel, whereby ink will flow in said channel around an air bubble in said channel; and an ink-permeable barrier attached to said conduit at said ink inlet such that said barrier is positioned between said ink passage and said reservoir, to prevent an air bubble in said ink passage from entering said reservoir.

6. An ink-jet cartridge in accordance with claim 5 wherein said capillary forming member of said second portion further comprises a rib protrusion into said channel.

7. An ink-jet cartridge in accordance with claim 5 wherein said second portion of said conduit further comprises an essentially polygonal cross-sectional channel substantially throughout its entire length.

8. A print cartridge for an ink-jet printer comprising:

a cartridge body enclosing a reservoir;

an ink sponge disposed in said reservoir for storing ink;

a bottom plate affixed to said body;

a print head affixed to said bottom plate;

a standpipe disposed in said body, contacting said ink sponge, and providing an ink conduit from said reservoir, said standpipe including an ink passage having an ink inlet and an ink outlet, said standpipe further including a groove in said ink passage extending essentially from said ink inlet to said ink outlet; and a channel fluidically connected to said standpipe ink outlet at a first end and fluidically connected to said print head at a second end, said channel further including a capillary forming member disposed longitudinally in said channel at least partially between said first end and said second end.

9. A print cartridge in accordance with claim 8 wherein said capillary forming member of said channel further comprises a rib protrusion into said channel.

10. A print cartridge in accordance with claim 8 wherein said channel further comprises a channel of essentially polygonal cross sectional profile substantially throughout its entire length.

11. A print cartridge in accordance with claim 8 wherein said channel further comprises at least two walls, a first of said at least two walls formed by said cartridge body and a second of said at least two walls formed by said bottom plate.

12. A print cartridge in accordance with claim 11 wherein said capillary forming member further comprises a rib protrusion disposed on said second of said at least two walls of said bottom plate.

13. A method of manufacturing a print cartridge for an ink-jet printer comprising the steps of:

forming a cartridge body having an interior reservoir;

including an ink sponge within said interior reservoir for storing ink;

affixing a print head to said cartridge body;

creating a standpipe in said body which contacts said ink sponge, said standpipe including an ink passage having an ink inlet and an ink outlet and a groove in said ink passage extending essentially from said ink inlet to said ink outlet;

forming a channel fluidically connected to said ink outlet at a first end and fluidically connected to said print head at a second end; and disposing a capillary forming member longitudinally in said channel at least partially between said first end and said second end.

14. A method in accordance with the method of claim 13 wherein said step of disposing a capillary forming member further comprises the step of forming a rib within said channel.

* * * * *